US006837169B2

(12) United States Patent
Michaelian et al.

(10) Patent No.: US 6,837,169 B2
(45) Date of Patent: Jan. 4, 2005

(54) END DOOR STRUCTURE FOR AN ALUMINUM VEHICLE CARRIER RAILCAR

(75) Inventors: Daryl H. Michaelian, Stuart, FL (US); Joel C. Haas, Jupiter, FL (US); Michael D. Howell, Tequesta, FL (US); Jose M. Cintron, Jupiter, FL (US); Alan B. C. Dixon, West Palm Beach, FL (US); Joe F. Englehart, Tequesta, FL (US); Bill W. Pankey, Jupiter, FL (US); Ronnie A. Shand, Jupiter, FL (US); William J. Spicer, Jupiter, FL (US); Martin E. Pettet, Jupiter, FL (US)

(73) Assignee: JAC Patent Company, Johnstown, PA (US)

( * ) Notice: Subject to any disclaimer, the term of this patent is extended or adjusted under 35 U.S.C. 154(b) by 0 days.

(21) Appl. No.: 10/419,043

(22) Filed: Apr. 17, 2003

(65) Prior Publication Data

US 2003/0221583 A1 Dec. 4, 2003

Related U.S. Application Data

(63) Continuation of application No. PCT/US01/42203, filed on Sep. 17, 2001.

(51) Int. Cl.[7] ..... B61D 17/00
(52) U.S. Cl. ..... 105/410
(58) Field of Search ..... 105/355, 359, 105/396, 404, 409, 410

(56) References Cited

U.S. PATENT DOCUMENTS

| | | | | |
|---|---|---|---|---|
| 3,911,831 A | | 10/1975 | Blunden | |
| 3,995,563 A | | 12/1976 | Blunden | |
| 3,996,860 A | * | 12/1976 | Ravani et al. | 49/70 |
| 4,084,516 A | * | 4/1978 | Ravani et al. | 410/26 |
| 4,240,357 A | | 12/1980 | Phillips | |
| 4,265,183 A | | 5/1981 | Pelsner et al. | |
| 4,318,349 A | * | 3/1982 | Galasan | 105/378 |
| 4,437,410 A | | 3/1984 | Stroller et al. | |
| 4,924,780 A | * | 5/1990 | Hart | 105/378 |
| 5,511,491 A | | 4/1996 | Hesch et al. | |
| 5,601,033 A | | 2/1997 | Ehrlich et al. | |
| 5,742,192 A | | 4/1998 | Banik | |
| 5,979,335 A | | 11/1999 | Saxton et al. | |
| 6,119,345 A | | 9/2000 | Lydle et al. | |

* cited by examiner

*Primary Examiner*—S. Joseph Morano
*Assistant Examiner*—Robert J. McCarry, Jr.
(74) *Attorney, Agent, or Firm*—Blynn L. Sbideler; Krisanne Shideler; BLK Law Group

(57) ABSTRACT

An aluminum vehicle carrier railcar has an end door system attached to at least one end of an upper structure thereof including an end door pair, each pivoting about a vertical axis and having an inner and outer door member. The members move from an aligned side-by-side closed position to an open overlapping, nested position exterior and adjacent a railcar side. The members have the same exterior side facing away from the railcar in both the open and the closed positions. A linkage assembly extends from each pivot axis to the members, and each includes a pivotable main arm, an inner arm extending from the main arm to the inner member and an outer arm extending from the main arm to the outer member. Guides extend between the members and between the outer door member and the railcar to guide the relative motion of the members.

20 Claims, 3 Drawing Sheets

END DOOR STRUCTURE FOR AN ALUMINUM VEHICLE CARRIER RAILCAR

CROSS REFERENCE TO RELATED APPLICATION

The present application is a continuation of and claims the benefit of co-pending international patent application serial number PCT/US01/42203 entitled "END DOOR STRUCTURE FOR AN ALUMINUM VEHICLE CARRIER RAILCAR" filed on Sep. 17, 2001 that is incorporated herein by reference in its entirety.

BACKGROUND OF THE INVENTION

1. Field of the Invention

The present invention relates to railcars for transporting vehicles, typically also called vehicle carrier railcars, and more particularly, directed toward a door system for an aluminum vehicle carrier railcar.

2. Background Information

Railcars have long been used for transporting vehicles long distances, in particular automobiles and light trucks, generally from the point of manufacture or import location to dealerships or locations where the automobiles or trucks can be subsequently transported by truck. As with other freight, a vehicle carrying railcar is designed to carry a maximum number of motor vehicles in each railcar. This has lead to the development of a bi-level or tri-level vehicle carrier railcar. In addition to the desire to carry a maximum number of vehicles on each vehicle carrier railcar, the existing railcars have been designed to minimize damage or vandalism of the vehicles such that many vehicle carrying railcars are designed as an enclosed structure. Conventionally, the existing vehicle carrier railcars are formed of steel that presents other problems for the railcar including additional weight and rust or corrosion in the cargo interior. Some attempts have been made to address this, such as a fiberglass panel articulated railcar disclosed in U.S. Pat. No. 5,511,491.

A number of end door systems are known for railcars, such as vehicle carrier railcars. U.S. Pat. No. 3,911,831 discloses a folding end door comprised of hinged panels. The panels of the door fold in overlying relationship to one another in the open position and unfold across the end of the railcar in the closed position. In the open position, the folded panels are positioned inside the railcar adjacent the sidewalls resulting in a reduced loading area. Moreover, in the closed position the panels do not extend across the gambrel roof of the railcar to prevent access into the railcar. Other folding end door systems are illustrated in U.S. Pat. Nos. 5,979,335 and 5,742,192 in which a pair of hinged three-panel doors close the respective ends of the railcar. Each three-panel door extends the entire height of the car body and extends from one side of the car body to the centerline of the car body. Each three-panel door may be swung open into a position in which the three vertically extending segments of each door, a corner panel, a middle panel and a center panel, nest alongside each other inside and adjacent the respective corner post of the car body.

U.S. Pat. No. 3,996,860 discloses a double bi-fold door assembly for the end opening of a vehicle, wherein each assembly includes an inner and an outer panel which are manipulated from the closed positioned to an open stored position by folding the inner panel 180 degrees into an overlaying arrangement with the outer panel and there after pivoting the two adjacent panels 270 degrees about the side edge of the car end opening to place each bi-fold door assembly in a stored position parallel to and outside of the side wall of the railcar.

U.S. Pat. No. 4,084,516 discloses a double bi-fold door assembly for the end opening of a vehicle, wherein each assembly includes an inner and an outer panel hinges together such that when opened the two inside panels are juxtaposed to each other and the two adjacent panels are placed in a stored position parallel to the side wall of the railcar. The folded assembly is pushed longitudinally toward the interior of the railcar until the folded door assembly is within the railcar interior.

U.S. Pat. No. 4,240,357 discloses a set of multiple paneled door assemblies for the end opening of a vehicle, wherein each assembly includes a plurality of hinged panels connected to permit the swinging of the panels outwardly or inwardly toward positions parallel to the wall of the railcar. Once in the open position the door assemblies may be selectively moved along the inside railcar side wall.

U.S. Pat. No. 4,318,349 discloses a double bi-fold door assembly for a vehicle end opening, wherein each assembly includes an inner and an outer panel hinged together with the inner panel being initially folded inwardly then outwardly over the end of the outer panel. The two folded panels are subsequently pivoted into an inner recessed position substantially parallel with the ends of the sidewalls of the railcar.

U.S. Pat. No. 5,601,033 discloses a double bi-fold door assembly for each end of an articulated train railcar, wherein each assembly has a first and a second panel hinged together and pivoted together relative to the railcar to place the folded assembly adjacent the exterior of the railcar.

Some end enclosures comprise doors that slide from the closed position to a position along the inside of the sidewalls. The doors are hung from a track member that is positioned along the edge of one of the decks. A space is provided between the side of the deck and the sidewalls at the end of the railcar so that a portion of the track is spaced and substantially parallel to the sidewalls. Thus, the doors can be moved along the track to a position along the inside of the sidewalls to enable access to the interior of the railcar. A suitable guide track or rail is usually provided adjacent the bottom edges of the doors. The guide track does not hinder the operation of the door and provides security by restricting the outward movement of the lower end of the door. Thus, access may not be gained to the interior of the railcar by pulling out the bottom edges of the doors away from the opening. A door of the type being described is disclosed in more detail in U.S. Pat. No. 4,437,410.

Since the edges where the roof and sidewalls are joined are sloped, it is not possible to extend the doors upwardly to completely fill the gable space and still slide the doors back along the sidewalls. The higher portion of the door would interfere with the sloped portions of the roof. Numerous schemes have been devised to attempt to fill the gable space. Some doors are built with top portions bent inwardly so that they will not interfere with the sloped portion of the roof as shown in U.S. Pat. No. 4,437,410. In some cases, complicated folding panels close the gable portion of the space as shown in U.S. Pat. No. 4,265,183. In yet other cases, the gable space is simply left open, see U.S. Pat. No. 3,996,860 discussed above.

One manner of solving the above problem, as suggested by U.S. Pat. No. 3,995,563, is to use an end closure comprising two sliding doors which move between closed and open positions. Upon opening of the doors, each door moves into an open space on the outer side of the railcar through a vertical opening in the sidewall. Each door includes an arcuate laterally outer portion and a straight laterally inner portion attached tangent to the laterally inner edge of the arcuate portion. Each door is supported to ride on an arcuate track having the same radius of curvature as the arcuate portion of the door. The door is supported on the track by rollers attached solely to the arcuate portion.

The opening in the sidewall allows the door to cover the gable portion of the space. However, the opening in the sidewall provides an undesirable degree of access to the interior of the railcar from outside, placing the contents of the railcar in jeopardy of damage from vandalism and other outside forces. In addition, support of the door on rollers only on the arcuate portion results in a relatively weak support of the laterally inward portions of the doors.

The extension of the door through the sidewall presents problems with respect to support of the required ladder at the end of the car. In the prior art, the ladder is supported by a brace beam connected to its top end. Because the door is taller than the height of the brace beam, a slot is cut in the door to allow it to open. This slot weakens the laterally outward upper corner of the door, which may be bent back to gain access to the interior of the car.

The above problems were also addressed in U.S. Pat. No. 4,924,780 which disclosed a track mounted, sliding, multi-panel door system for a vehicle carrier railcar. The difficulty with this proposed system is the large amount of force required to open it due to the door system's excessive height and the application of force relatively far from one of the roller tacks. Furthermore, in track based systems, the rollers will develop flat spots while resting in the closed position making track based door operating systems harder to operate. Frequent adjustment and lubrication does not adequately compensate for these causes of binding. Furthermore, in automobile or vehicle carrier railcars, lubrication is undesirable, since the lubrication will find its way into the apolstered interior of the automobiles damaging the cargo. Furthermore, in the existing track based door systems, the arc of the door minimizes the vehicle drive-in clearance of the railcar when the door is in the fully open position.

Consequently, there is a need to provide a door system for a railcar, such as a vehicle railcar, which eliminates tracks, rollers, flat spots or lubrication to the greatest extent possible. There is a further need to provide an end door system for a railcar which will open and be positioned flat against the outside of the railcar and, therefore, not hinder the loading and unloading of the vehicles.

SUMMARY OF THE INVENTION

The above objects are achieved with an aluminum vehicle carrier railcar with an end door system according to the present invention attached to at least one end of the upper structure of the railcar. A bi-level aluminum vehicle carrier utilizes an end door system of the present invention for attachment to a vehicle carrier railcar for opening and closing an end of the cargo space of the railcar. The door system includes a pair of end doors that pivot about a vertical pivot axis. Each door includes an inner door member and an outer door member. The door members are connected for movement from an aligned side-by-side position closing the cargo space when the door is in the closed position to an overlapping, nested position exterior and adjacent to a side of the railcar when the door is in the open position. The inner and outer door members have the same exterior side facing away from the railcar in both the open and the closed position. A pair of linkage assemblies are provided with each extending from the pivot axis to the inner door member and the outer door member. Each linkage assembly includes a main linkage arm pivotable about the vertical pivot axis, an inner door linkage arm extending from the main linkage arm to the inner door member and an outer door linkage arm extending from the main linkage arm to the outer door member. Guide members extend between the inner door member and the outer door member and between the outer door member and the railcar to guide the relative motion of the door members during opening.

These and other advantages of the present invention will be clarified in the detailed description of the preferred embodiment together with the attached figures in which like reference numerals represent like elements throughout.

DETAILED DESCRIPTION OF THE PREFERRED EMBODIMENT

Figure 1:
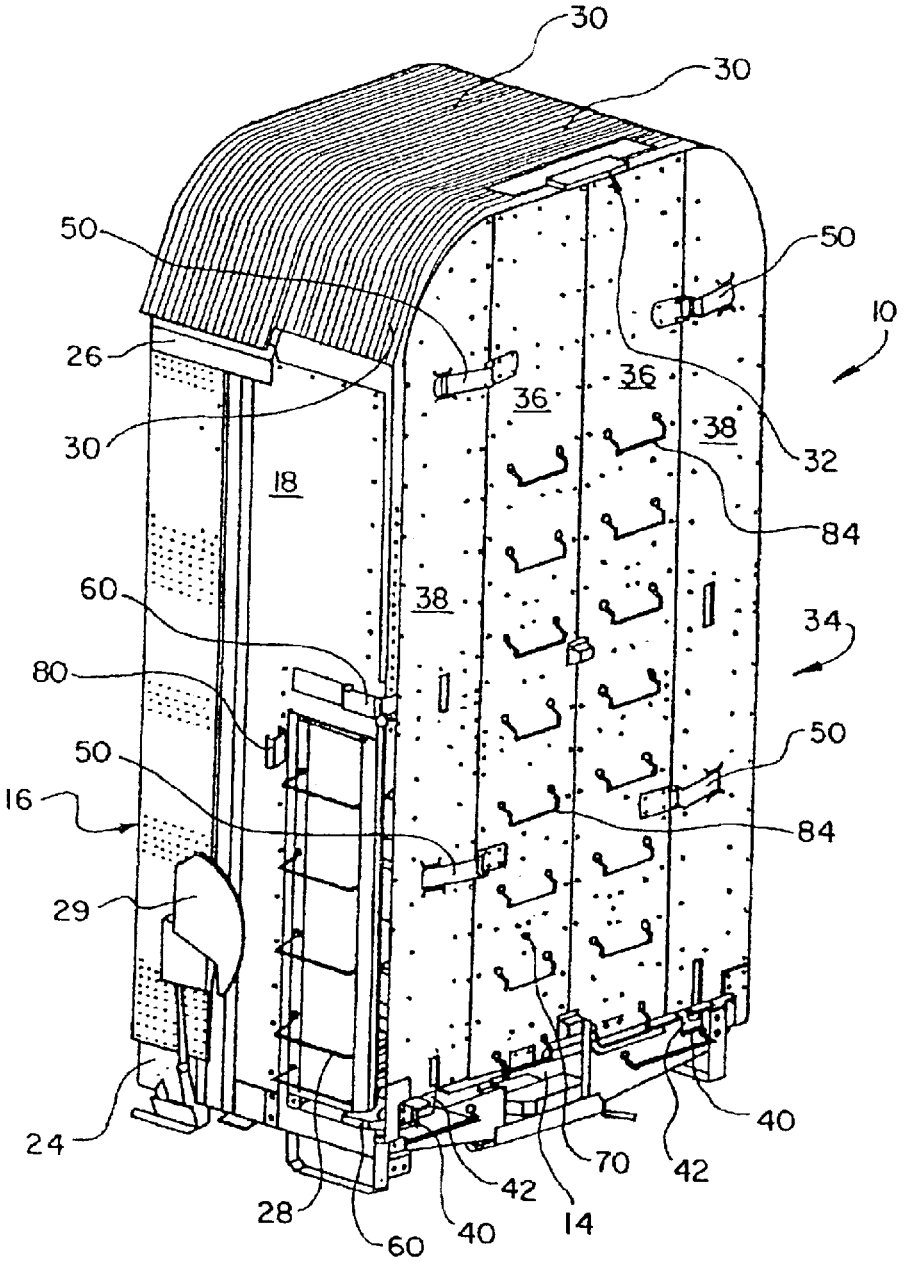
FIG. 1 is a perspective view of an aluminum vehicle carrier railcar with a door system according to the present invention with the doors in the closed position.
Figure 2:
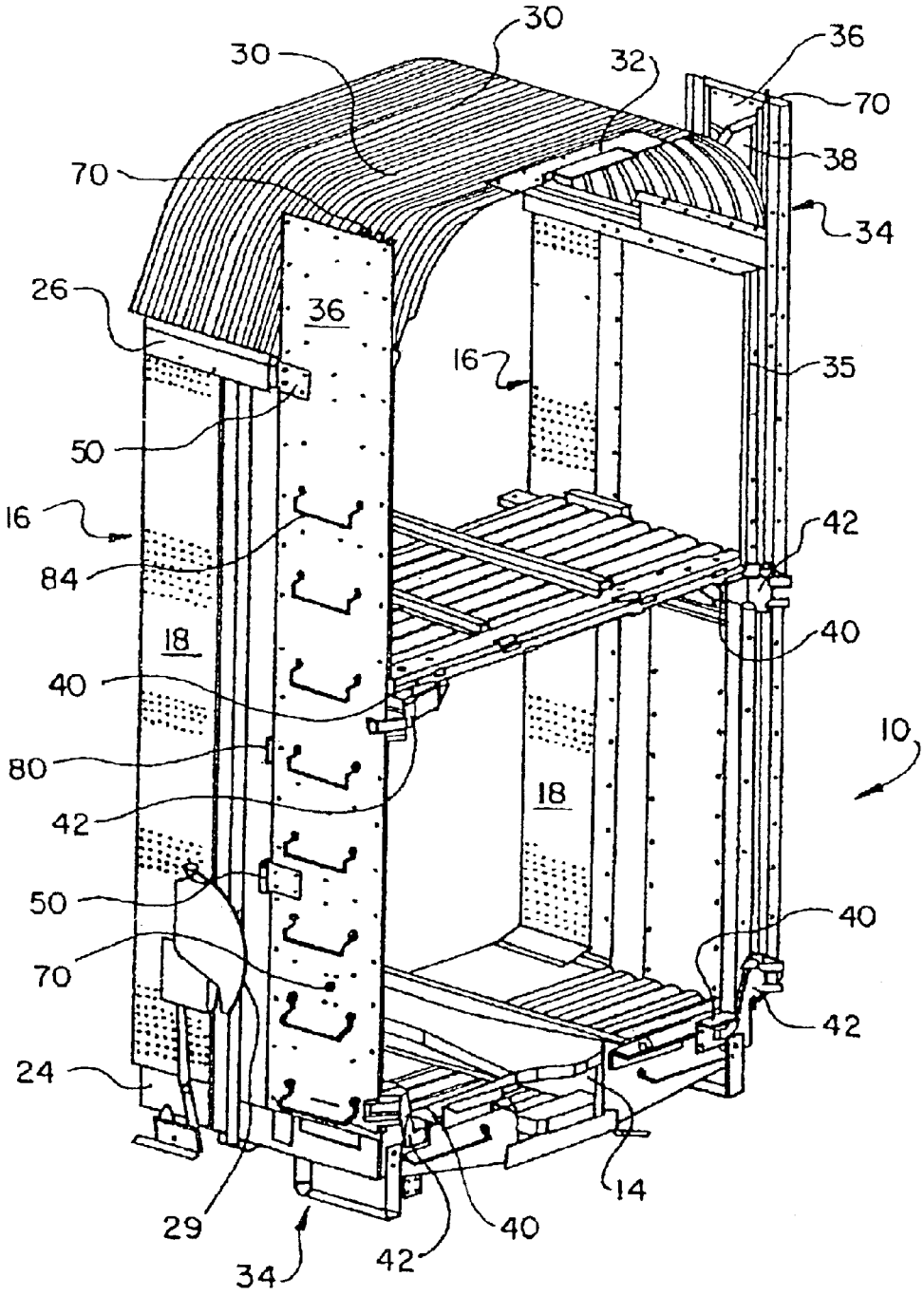
FIG. 2 is a perspective view of an aluminum vehicle carrier railcar with a door system according to the present invention with the doors in the open position.
Figure 3:
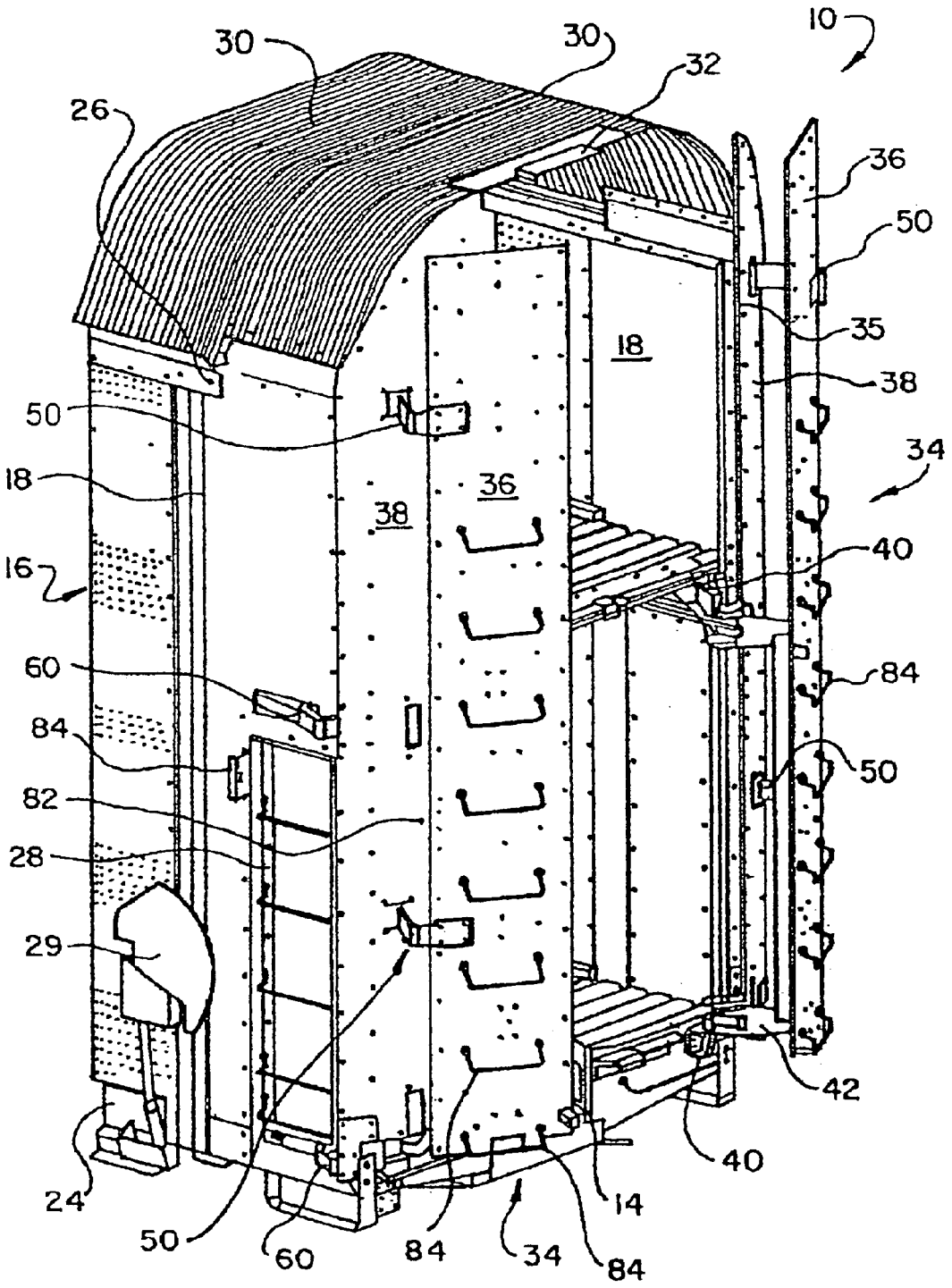
FIG. 3 is a perspective view of an aluminum vehicle carrier railcar with a door system according to the present invention with the doors in a partially open position.

An aluminum vehicle carrier railcar 10 according to the present invention is illustrated in FIGS. 1–3. The aluminum vehicle carrier railcar 10 of the present invention utilizes a steel underframe supported on a pair of spaced trucks. The steel underframe is formed with a pair of two-piece cast steel draft arms 14 (also called draft sills), a roll formed center sill (not shown) extending between the trucks and other steel underframe components. The cold formed center sill is described in U.S. Pat. No. 6,119,345, which is incorporated herein by reference. An aluminum upper structure 16 is attached onto the steel underframe. The aluminum upper structure 16 includes a pair of aluminum spaced side panels 18. The side panels 18 include a plurality of spaced aluminum side stakes with perforated aluminum side sheets extending between and attached to each adjacent pair of side stakes to form the side panels 18. Only one side stake and side sheet is shown in the figures.

The side panels 18 extend between and are attached to a side sill 24 and a top chord 26. The ends of the side panels 18 include access ladders 28 near the hand brake 29. A roof structure or roof system is formed of overlapping corrugated and rolled aluminum members 30 extending between and attached to the top chord 26. The ends of the roof structure includes roof latch strikers 32 to assist in the closure of end doors 34.

Corner posts 35 are provided at the end of the side panel structure extending between the side sill 24 and the top chord 26 to provide a mounting position for the pivotable end doors 34. The doors 34, the side panel structures and the roof structure combine to form an enclosed cargo area for the aluminum vehicle carrier railcar 10. The interior compartment of the aluminum vehicle carrier 10 includes an aluminum decking and other aluminum components to prevent any substantial ferrous material from being exposed to the vehicles in the cargo area. The upper surface of the cast draft arms in the cargo area will be coated, such as by spraying or the like, to prevent exposure to the cargo interior. An advantage of the vehicle carrier railcar 10 of the present invention is that the interior is substantially all aluminum since the side walls, the decking, the roof and the doors are formed primarily of aluminum and, therefore, substantially non-corrosive. Other metal components within the interior can be formed of stainless steel or coated material or otherwise of a non-corrosive type material to essentially eliminate the rust problem in the cargo interior.

The details of the doors 34 are shown in detail in FIGS. 1–3 and represent the heart of the presently claimed invention. Each door 34 includes an inner door member 36 and an outer door member 38. Each door member 36 and 38 is formed of aluminum sheets attached to a substantially aluminum framework. The aluminum door members 36 and 38 are formed by aluminum frameworks. The aluminum door members 36 and 38 may have minor components formed of non-aluminum, such as stainless steel or the like. However, these are maintained to a minimum for the reasons discussed above. As best shown in FIGS. 2 and 3, each door 34 is pivotably attached to the corner post 35 through a vertical pivot axis 40. A linkage assembly 42 extends from pivot access 40 for connecting both the inner door member 36 and the outer door member 38 to the railcar 10. Each linkage assembly 42 includes a main linkage arm pivotable arm pivotable about the vertical pivot axis 40, an inner door linkage arm extending from the main linkage arm to the inner door member 36 and an outer door linkage arm extending from the main linkage arm to the outer door member 38. A pair of guide members 50 are pivotally attached between the inner door member 36 and the outer door member 38 to guide the movement of the inner door member 36 relative to the outer door member 38 during the opening movement. In a similar fashion, a pair of guide members 60 are pivotally connected to the side panel 18 and the outer door member 38 to guide the relative movement of the outer door member 38 relative to the side panel 18 during the opening movement. As evidenced in FIG. 1, the guide members 50 and 60 are provided with an offset that allows for the nesting of the inner door member 36 within the outer door member 38 in the open position. Consequently, in the open position the inner door member 36, the outer door member 38 and the side panel 18 of the railcar 10 are substantially parallel. Additionally in both the closed and the open position the same side (the exterior side) of the inner door member 36 and the outer door member 38 face away from the railcar 10.

Each door 34 additionally includes a locking mechanism 70 for securing the doors in the closed position which can include a striker bar locking into the roof latch plate striker 32. The locking mechanism 70 may further latch the doors 34 to each other in the closed position. Furthermore, a latch 80 is attached to the side panel 18 cooperating with a spring-biased receiving member or catch 82 in the inner door member 36 to hold the doors 34 in the fully open position. The locking mechanism 70 can also be utilized for releasing the catch 82 and releasing the doors 34 from the fully open position.

The exterior of each inner door 36 is included with a ladder which extends up and to the upper deck of the cargo area. As illustrated in the drawings in the open position, the ladder 84 can be used for accessing the upper deck. However, in the closed or open positions, the ladder 84 does not provide access to the roof of the railcar 10.

The end door design of the present invention allows for easy access for opening of the vehicle carrier railcar 10. The design is essentially based upon a simple bar linkage system which links each of the inner door member 36 and outer door member 38 together for each door 34 and securely attaches the doors 34 to the upper structure 16 (or other structure) of the railcar 10. When the doors 34 are opened, they fold onto themselves giving ample clearance for the exterior hand brake 29 as well as for access for loading and unloading the cars or small trucks. The doors 34 of the present invention are intended to snap or lock automatically onto the side of the railcar 10 with the door members 36 and 38 nested on top of themselves with the handbrake 29 easily accessible and the end opening of the railcar 10 unobstructed. It is anticipated that the same locking mechanism 70 that unlocks the door 34 from the closed position will release the doors from the stowed position on the side of the railcar 10. The present invention is intended to additionally decrease roof access and minimize door openings in the closed positions to protect the cargo in the interior, and to further provide an easy locking/unlocking operation and provide increase drive-in clearance to the open railcar while maintaining appropriate handbrake access. Furthermore, the door system of the present invention is intended to operate with a reduced access or operating force and without lubrication.

It will be readily apparent to those of ordinary skill in the art that various changes may be made to the present invention without departing from the spirit and scope thereof. The described embodiment is intended to be illustrative of the present invention and not restrictive thereof. The scope of the present invention is intended to be defined by the appended claims and equivalents thereto.

We claim:

1. A vehicle carrier railcar comprising:

an upper railcar frame structure supported on an underframe, the upper railcar frame structure defining an enclosed multi-level cargo space; and an end door system attached to at least one end of the upper railcar frame structure for opening and closing an end of the cargo space defined by the upper railcar frame structure, the door system comprising a pair of end doors pivotally each attached to the upper railcar frame structure through a vertical pivot axis, each door including an inner door member and an outer door member in which the door members are connected for movement from an aligned side-by-side position extending from the side of the railcar to a centerline of the railcar closing the cargo space when the door is in the closed position to an overlapping, nested position exterior and adjacent to the upper structure when the door is in the open position, wherein said inner and outer door members have the same exterior side facing away from said railcar in both said closed and open positions.

2. The railcar as claimed in claim 1 wherein a linkage assembly couples the inner door member and the outer door member of each end door to the upper railcar frame structure for pivoting about the vertical pivot axis.

3. The railcar as claimed in claim 2 wherein at least one guide member is pivotably attached to and extending between the inner door member and the outer door member of each end door for guiding relative movement of the inner door member relative to the outer door movement during opening of the end door.

4. The railcar as claimed in claim 3 wherein at least one guide member is pivotably attached to and extending between the outer door member of each end door and the upper railcar frame structure for guiding relative movement of the outer door member relative to the upper railcar frame structure during opening of the end door.

5. The railcar as claimed in claim 4 wherein the guide members include an offset for accommodating the nesting of the inner door member on the outer door member of each end door in the open position, wherein in the open position the inner door member, the outer door member and a side of the upper structure are substantially parallel.

6. The railcar as claimed in claim 1 further including a latch for each end door for holding the end doors in the open position.

7. The railcar as claimed in claim 1 wherein the inner door member of at least one end door includes a ladder on an exterior side thereof which is accessible when the end door is in both the closed and open positions.

8. An end door system for attachment to an upper railcar frame structure of a vehicle carrier railcar for opening and closing an end of the cargo space of the railcar, the door system comprising:

a pair of end doors pivotably attached to the railcar frame structure through a vertical pivot axis, each door including an inner door member, and an outer door member, wherein the door members are connected for movement from an aligned by side position extending from the side of the railcar to a centerline of the railcar closing the cargo space when the door is in the closed position to an overlapping, nested position exterior and adjacent to a side of the railcar when the door is in the open position, wherein said inner and outer door members each have the same exterior side facing away from said railcar in both said closed and open positions.

9. The door system as claimed in claim 8 wherein a linkage assembly couples the inner door member and the out door member of each end door to the railcar frame structure for pivoting about the vertical pivot axis.

10. The door system as claimed in claim 9 wherein at least one guide member is pivotably attached to an extending between the inner door member and the outer door member of at least one end door for guiding relative movement of the inner door member relative to the outer door movement during opening of the end door.

11. The door system as claimed in claim 10 wherein the guide members include an offset for accommodating the nesting of the inner door member on the outer door member of the end door in the open position, wherein in the open position the inner door member, the outer door member and a side of the railcar is substantially parallel.

12. The door system as claimed in claim 8 further including a latch for holding at least one end door in the open position.

13. The door system as claimed in claim 8 wherein the inner door member of at least one end door includes a ladder on an exterior side thereof which is accessible when the end door is in both the closed and open positions.

14. An aluminum vehicle carrier railcar comprising:

an aluminum upper railcar frame structure supported on a railcar under-frame having a cold formed center sill, the aluminum upper structure defining an enclosed bi-level cargo space; and an aluminum end door system attached to one end of the aluminum upper structure for opening and closing the end of the cargo space, the door system comprising a pair of end doors pivotally attached to the upper railcar frame structure through a vertical pivot axis, each end door including at least an inner door member and an outer door member in which the door members of each end door are connected for movement from an aligned side-by-side position extending from the side of the railcar closing the cargo space when the door is in the closed position to an overlapping, nested position exterior and adjacent to the upper structure when the door is in the open position, wherein said inner and outer door members each have the same exterior side facing away from said railcar in both said closed and open positions.

15. The railcar as claimed in claim 14 wherein the inner door member of at least one end door includes a ladder on an exterior side thereof which is accessible when the end door is in both the closed and open positions.

16. The railcar as claimed in claim 15 further including a latch for holding at least one end door in the open position.

17. The railcar as claimed in claim 16 wherein a linkage assembly couples the inner door member and the out door member of each end door to the railcar frame structure for pivoting about the vertical pivot axis.

18. The railcar as claimed in claim 17 wherein at least one guide member is pivotably attached to an extending between the inner door member and the outer door member of at least one end door for guiding relative movement of the inner door member relative to the outer door movement during opening of the end door.

19. The railcar as claimed in claim 18 wherein the guide members include an offset for accommodating the nesting of the inner door member on the outer door member of an end door in the open position, wherein in the open position the inner door member, the outer door member and a side of the railcar is substantially parallel.

20. The railcar of claim 19 further including a locking mechanism holding at least one end door in the open and closed position.

* * * * *